US008816603B2

(12) United States Patent
Branchetti et al.

(10) Patent No.: US 8,816,603 B2
(45) Date of Patent: Aug. 26, 2014

(54) METHOD FOR CONTROLLING THE OPERATION OF AN ELECTRONIC CONVERTER, AND A CORRESPONDING ELECTRONIC CONVERTER, LIGHTING SYSTEM AND SOFTWARE PRODUCT

(75) Inventors: Filippo Branchetti, Treviso (IT); Alessandro Brieda, Sacile (IT); Paolo De Anna, Riese Pio X (IT); Tobias Frost, Burglengenfeld (DE); Uwe Liess, München (DE)

(73) Assignee: OSRAM GmbH, Munich (DE)

( * ) Notice: Subject to any disclaimer, the term of this patent is extended or adjusted under 35 U.S.C. 154(b) by 135 days.

(21) Appl. No.: 13/513,857

(22) PCT Filed: Nov. 26, 2010

(86) PCT No.: PCT/EP2010/068287

§ 371 (c)(1),
(2), (4) Date: Jun. 4, 2012

(87) PCT Pub. No.: WO2011/067177

PCT Pub. Date: Jun. 9, 2011

(65) Prior Publication Data

US 2012/0235598 A1 Sep. 20, 2012

(30) Foreign Application Priority Data

Dec. 4, 2009 (IT) ..... TO2009A0953

(51) Int. Cl.
*H05B 37/02* (2006.01)

(52) U.S. Cl.
USPC ..... 315/297; 315/246; 315/307

(58) Field of Classification Search
USPC ..... 315/209 R, 246, 291, 294, 297, 307, 308
See application file for complete search history.

(56) References Cited

U.S. PATENT DOCUMENTS

| | | | | |
|---|---|---|---|---|
| 6,552,501 | B2 * | 4/2003 | Ito et al. | 315/308 |
| 7,804,256 | B2 * | 9/2010 | Melanson | 315/291 |
| 8,232,736 | B2 * | 7/2012 | Melanson | 315/247 |
| 8,363,004 | B2 * | 1/2013 | Ye et al. | 345/102 |
| 2007/0285031 | A1 * | 12/2007 | Shteynberg et al. | 315/294 |

FOREIGN PATENT DOCUMENTS

| | | |
|---|---|---|
| DE | 20 2004 006 292 | 7/2004 |
| EP | 1 517 588 | 3/2005 |
| JP | 2003-519895 | 6/2003 |

(Continued)

*Primary Examiner* — Tung X Le
(74) *Attorney, Agent, or Firm* — Cozen O'Connor

(57) ABSTRACT

A method for controlling the operation of an electronic converter (10), comprising a power output (120) for providing a power supply signal (120) for a light source (L), wherein said light source (L) is coupled to an identification element (300, 400) which identifies at least one control parameter of said light source (L), and a data line (200*b*) for connection to said identification element (300, 400), wherein said method comprises: detecting (1002) the value of the voltage on said data line; (200*b*), comparing (1004, 1010) the detected value of said voltage with at least a first and a second range of values; (802, 804, 806), and a) determining said at least one control parameter as a function of the detected voltage (1002, 1044) on said data line (200*b*), if the detected voltage is within the first range (802), or b) communicating (1032) with said identification element (300) by means of a digital communication protocol in order to receive said at least one control parameter from said identification element (300) if the detected voltage is within the second range (804).

13 Claims, 4 Drawing Sheets

(56) References Cited

FOREIGN PATENT DOCUMENTS

| | | |
|---|---|---|
| JP | 2005-093196 | 4/2005 |
| JP | 2006-351484 | 12/2006 |
| JP | 2009-016459 | 1/2009 |
| JP | 2013-513199 | 4/2013 |

* cited by examiner

METHOD FOR CONTROLLING THE OPERATION OF AN ELECTRONIC CONVERTER, AND A CORRESPONDING ELECTRONIC CONVERTER, LIGHTING SYSTEM AND SOFTWARE PRODUCT

RELATED APPLICATIONS

This is a U.S. National Phase Application under 35 USC 371 of International Application PCT/EP2010/068287 filed on Nov. 26, 2010.

This application claims the priority of Italian application no. TO2009A000953 filed Dec. 4, 2009, the entire content of which is hereby incorporated by reference.

FIELD OF THE INVENTION

The description relates to control methods and circuits for electronic converters.

The description makes particular reference to possible use in electric converters for light sources comprising at least one LED.

BACKGROUND OF THE INVENTION

Light sources of the type comprising, for example, at least one LED are usually supplied through an electronic converter which provides a continuous current at its output. This current can be stable or can vary over time, for example in order to control the intensity of the light emitted by the source (by what is known as a "dimming" function). For example, the current can be controlled in the electronic converter by a control method using pulse width modulation (PWM).

However, the operating conditions can vary between different light sources. For example, there can be variations, which may be significant, in the nominal (or requested) or maximum current, the wavelength of the emitted light, and the like.

A possible solution for this problem is to use LED modules (or "light engines"), each of which comprises an identification element for identifying at least one control parameter of the LED module. In this case, the electronic converter comprises a control circuit which communicates with the identification element and adapts the operation of the electronic converter to the specific operating conditions required by the LED module.

For example, in the simplest case, the identification element can be an impedance (such as a resistor or capacitor) which identifies the supply current required by the LED module.

The identification element can also be more complex and can comprise a control unit such as a microprocessor, which supplies the corresponding data through a digital communication interface.

An "intelligent" identification element (that is to say, one having a digital communication interface) is usually capable of handling a plurality of control parameters (such as control parameters relating to information on the state of the LED module and/or for the dimmer operation) more effectively than a "simple" identification element (that is to say, one having an analog communication interface).

The inventors have observed that there are problems of compatibility between electronic converters and LED modules where the latter are not all of the same type. This is because an electronic converter intended for use with a "simple" LED module cannot recognize an "intelligent" LED module, and vice versa. This means that the correct LED module must be selected for a specific electronic converter, or vice versa, and that, when an electronic converter is replaced by a converter of a different type, all the LED modules must also be replaced.

The inventors have also observed that the use of a single type of LED module is inconvenient. For example, the simpler LED modules are unable to provide some control parameters. A possible solution to this problem could be to add a control unit to each simpler module. However, such a control circuit would be rather costly and would therefore make this solution inefficient.

SUMMARY OF THE INVENTION

One object of the invention is to overcome the drawbacks described above.

This and other objects are attained in accordance with aspects of the invention directed to a control method, a corresponding electronic converter, a lighting system, and a software product which can be loaded into the memory of a computer (such as a microcontroller) and which comprises pieces of software code which can implement the steps of the method when the product is executed on a computer. As used herein, the reference to this software product is to be interpreted as a reference to a computer-readable means containing instructions for the control of the processing system for coordinating the implementation of the method according to the invention.

One embodiment of the method for controlling the operation of an electronic converter comprises a power output for providing a power supply signal for a light source, in which said light source is coupled to an identification element which identifies at least one control parameter of said light source, and a data line for connection to said identification element, wherein said method comprises: detecting the value of the voltage on said data line, comparing the detected value of said voltage with at least a first and a second range of values, and a) determining said at least one control parameter as a function of the detected voltage on said data line, if the detected voltage is within the first range, or b) communicating with said identification element by means of a digital communication protocol in order to receive said at least one control parameter from said identification element if the detected voltage is within the second range.

Various embodiments provide a control circuit for an electronic converter capable of recognizing "simple" and "intelligent" LED modules.

In various embodiments, the control circuit comprises a data line for connection to an identification element.

In various embodiments, the control unit distinguishes a simple LED module from an intelligent LED module as a function of the voltage measured on the data line.

In various embodiments, the LED module is classified as simple if the measured voltage is within a first range, while it is classified as intelligent if the voltage is within a second range.

In various embodiments, a measurement signal is applied to the data line. For example, this measurement signal can be generated by the control circuit and/or by the LED module.

In various embodiments, the LED module comprises a resistance and/or a Zener diode between the data line and the ground. In this case, the control unit and/or the LED module can apply a measurement current or a voltage to the data line through a pull-up device to create a corresponding voltage between the data line and ground.

In various embodiments, the control circuit comprises an analog-digital converter to measure the voltage on the data line.

In various embodiments, the control unit communicates with the identification element by means of a digital communication protocol if the LED module has been classified as intelligent. In various embodiments, the control unit uses the measured voltage to adapt the operation of the electronic converter if the LED module has been classified as simple.

In various embodiments, the identification element identifies at least the supply current required by the LED module.

DETAILED DESCRIPTION OF THE DRAWINGS

The following description illustrates various specific details intended to provide a deeper understanding of the embodiments. The embodiments may be produced without one or more of the specific details, or may use other methods, components, materials, etc. In other cases, known structures, materials or operations are not shown or described in detail, in order to avoid obscuring various aspects of the embodiments.

The reference to "an embodiment" in this description is intended to indicate that a particular configuration, structure or characteristic described in relation to the embodiment is included in at least one embodiment. Therefore, phrases such as "in an embodiment", which may be present in various parts of this description, do not necessarily refer to the same embodiment. Furthermore, specific formations, structures or characteristics may be combined in a suitable way in one or more embodiments.

The references used herein are purely for convenience and therefore do not define the scope of protection or the extent of the embodiments.

Figure 1:
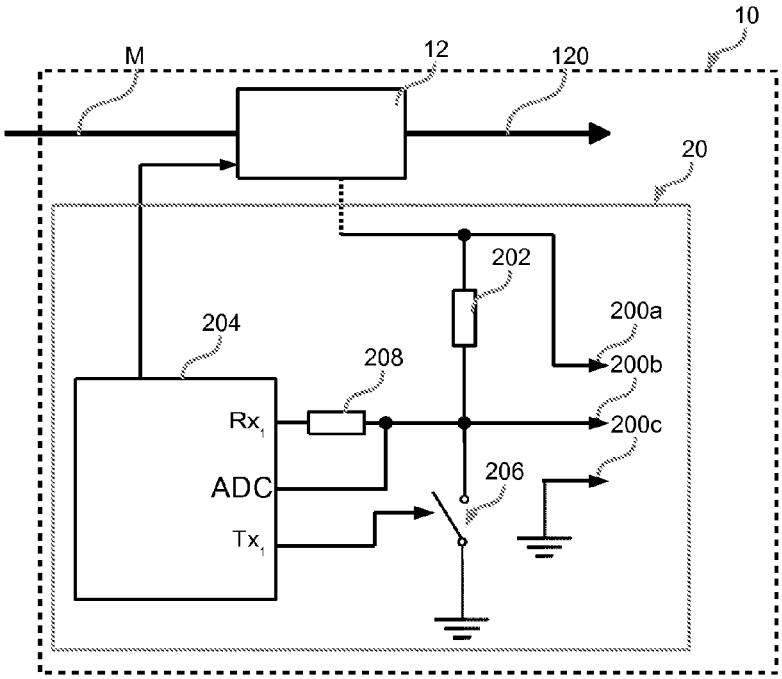
FIG. 1 is a circuit diagram of an embodiment of an electronic converter.

FIG. 1 shows a possible embodiment of an electronic converter 10 comprising a power circuit 12 (for example an AC/DC or DC/DC switching power supply) and a control circuit 20.

In various embodiments, the power circuit 12 receives at its input a power supply signal M (from the electrical main supply, for example) and supplies at its output, through a power output 120, a current whose mean intensity can be controlled by means of the control circuit 20 (using amplitude modulation and/or pulse width modulation, for example).

In the present embodiment, the control circuit 20 comprises a communication interface comprising three lines, as follows:

- a power supply line 200*a* for providing a power supply signal,
- a data line 200*b* for communication with an identification element, and
- a ground 200*c*, for example a ground separated from the ground of the electronic converter to avoid disturbances caused by the operation of the converter.

In the present embodiment, the power supply line 200*a* is connected to a continuous voltage supplied by the power circuit 12.

In various embodiments, the power supply line 200*a* is not connected directly to the power output 120 of the electronic converter 10. This is because the power output 120 of the converter 10 can have a variable voltage which cannot be used directly to supply a digital circuit. However, the signal at the power output 120 of the power circuit 12 can be used to derive a stable signal at low or very low voltages (for example, 3 V, 5 V or 12 V).

In various embodiments, the data line 200*b* can be used for half duplex bidirectional communication; that is to say, the transmission means is the same for both the transmission and the reception of data. For example, in various embodiments, a serial communication protocol, for example the 1-wire protocol, or any half duplex serial protocol, for example one using unipolar encoding, Manchester code or biphase mark code (BMC), is used.

In various embodiments, the data line 200*b* is connected to a control unit 204, for example a microprocessor, which controls the bidirectional communication on the data line 200*b*.

In various embodiments, the control unit 204 comprises an input RXi for detecting the logic level on the data line 200*b*.

In various embodiments, the control unit 204 also comprises an output TXi for driving the data line 200*b*.

For example, in the present embodiment, the data line 200*b* is connected through a pull-up resistor 202 to the power supply line 200*a* and the signal from the output Xi of the control unit 204 is connected to an electronic switch 206 (for example a MOSFET) to connect the data line 200*b* selectively to the ground 200*c*.

For example, the switch 206 is closed and the data line 200*b* is set to the logic level λ0' if the line Xi is set to the logic level λ1'. Conversely, the data line 200*b* remains connected through the resistor 202 to the power supply 200*a* if the line TXi is set to the logic level λ0'. This means that the logic level on the data line 200*b* is normally set to λ1', even if an external connection with low resistance between the data line 200*b* and the ground 200*c* (for example an identification element connected to the control circuit) can bring the logic level back down to λ0'.

In various embodiments, the control unit 204 also comprises a second input ADC connected to an analog-digital converter.

Thus the control unit 204 can detect both the logic level and the voltage on the data line 200*b*.

The control circuit can also comprise further components, which are omitted from the illustration in order to simplify the description of the operation of the control circuit 20. For example, the circuit 20 can comprise capacitors for filtering disturbances toward and/or from the communication interface, and/or components for protecting the control circuit 20 from excess voltages and/or currents. FIG. 1 shows, by way of example, only one resistor 208 which limits the current at the input $RX_2$ of the control unit 204.

Figure 2:
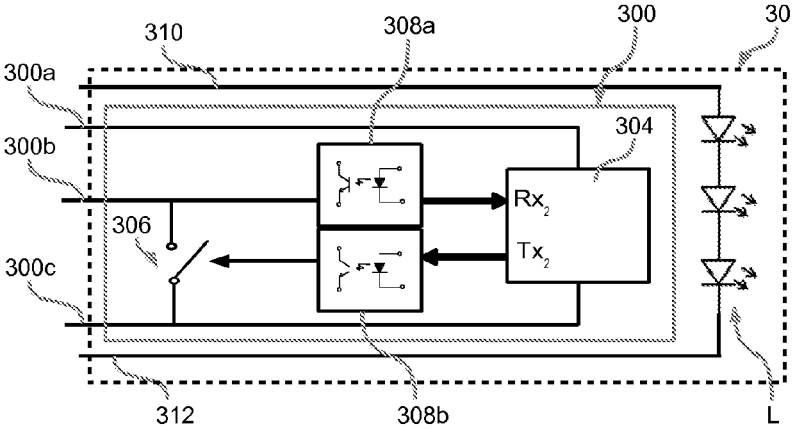
FIG. 2 is a circuit diagram of an embodiment of an intelligent LED module.

FIG. 2 shows a possible embodiment of an "intelligent" LED module 30 which can be connected to the electronic converter 10 of FIG. 1.

In various embodiments, the LED module 30 comprises at least one LED L and an intelligent identification element 300.

In various embodiments, the LED or LEDs L of the LED module 30 are supplied by means of a power supply signal 310 which is connected to the power output 120 of the electronic converter 10.

In various embodiments, the identification element comprises a control unit 304, for example a microprocessor, which is connected to a communication interface composed of the following three lines:

- a power supply line 300*a* for connection to the power supply line 200*a* of the control circuit 20,
- a data line 300*b* for connection to the data line 200*b* of the control circuit 20, and
- a ground 300*c* for connection to the ground 200*c* of the control circuit 20.

In this case also, the power supply signal 310 can be used to derive a power supply signal 300*a*. In this case, it is not even necessary to make a connection to the power supply line 200*a* of the electronic converter 10.

In the present embodiment, a separate ground line 312 is also provided for supplying the LEDs, in order to avoid the propagation of disturbances along the power supply line 310 toward the identification element 300.

In various embodiments, the data line 300*b* can be used for half duplex bidirectional communication.

For example, in the present embodiment, the control unit 304 comprises an input $RX_2$ for detecting the logic level on the data line 300*b* and an output $TX_2$ for driving the data line 300*b*.

In the present embodiment, the signal from the output $TX_2$ of the control unit 304 is connected to an electronic switch 306 (for example a transistor) in order to connect the data line 300*b* selectively to the ground 300*c*. This means that the switch 306 is closed and the data line 300*b* is set to the logic level ^0' if the line $TX_2$ is set to the logic level ^1'. Conversely, the data line 200*b* maintains its logic level if the line $TX_2$ is set to the logic level '0'.

The identification element 300 can also comprise further components, which have been omitted from the illustration in order to simplify the representation of the operation of the LED module 30. For example, the module 30 can comprise capacitors for filtering disturbances toward and/or from the communication interface, and/or components for protecting the module 30 from excess voltages and/or excess currents.

For example, FIG. 2 shows two optical isolators 308*a* and 308*b* for optically isolating the control unit 304 from the data line 300*b*. In particular, in the present embodiment, the input of the optical isolator 308*a* is connected to the data line 300*b* and the output of the optical isolator 308*a* is connected to the input $RX_2$ of the control unit 304. On the other hand, the input of the optical isolator 308*b* is connected to the output $TX_2$ of the control unit 304, and the output of the optical isolator 308*b* is connected to the electronic switch 306.

Figure 3:
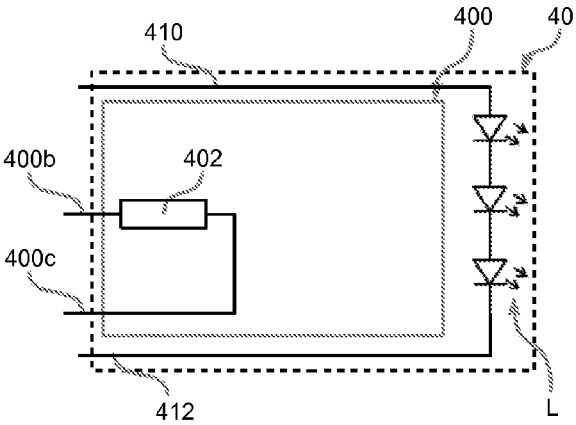
FIG. 3 is a circuit diagram of a first embodiment of a simple LED module.

FIG. 3 shows a possible embodiment of a "simple" LED module 40 which can be connected to the electronic converter 10 of FIG. 1.

In various embodiments, the LED module 40 comprises at least one LED L and a simple identification element 400.

In various embodiments, the LED or LEDs L of the LED module 40 are supplied by means of a power supply signal 410 which is connected to the power output 120 of the electronic converter 10.

In various embodiments, the identification element 400 comprises only one resistance (for example a resistor) 402 connected between the following two lines:

- a data line 400*b* for connection to the data line 200*b* of the control circuit 20, and
- a ground 400*c* for connection to the ground 200*c* of the control circuit 20.

In this case also, a separate ground line 412 can be provided for supplying the LEDs, in order to avoid the propagation of disturbances along the power supply line 410 toward the identification element 400.

In various embodiments, the value of the resistance 402 identifies at least one control parameter, for example the current required by the LED module.

The simple LED module can also include further components, for example sensors and/or circuits, which selectively vary the value of the resistance 402.

Figure 4:
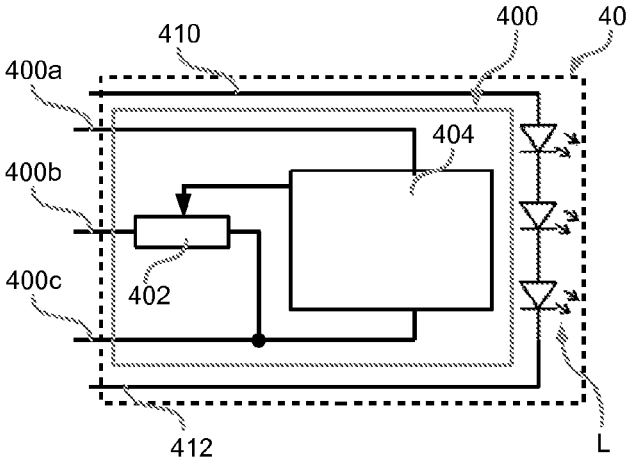
FIG. 4 is a circuit diagram of a second embodiment of a simple LED module.

For example, FIG. 4 shows a possible embodiment of a simple LED module 40 including at least one circuit 404 which selectively varies the value of the resistance 402 connected between the data line 400*b* and the ground 400*b*.

For example, the circuit 404 can be an analog and/or digital circuit (supplied for example by means of a power supply line 400*a*) which controls the value of the resistance 402 to compensate for the effect of temperature on the required current.

In the present embodiment, the circuit 404 is supplied through an input 400*a* connected to the power supply line 200*a* of the control circuit 20.

In this case also, the power supply signal 410 can be used to derive the power supply signal 400*a*. In this case, it is not even necessary to make a connection to the power supply line 200*a* of the electronic converter 10.

In the embodiment shown in FIG. 1, the data line 200*b* is connected through a pull-up resistor 202 to the power supply line 200*a*. However, this resistor could be located in the identification element instead, or a pull-up resistor could be included in both the control circuit 20 and the identification element. However, the presence of a pull-up resistor (or a pull-down resistor with a different resistance) in the converter 10 is useful for preventing the data line 200*b* from becoming disconnected (that is to say, being at an unknown voltage) in cases where no LED module is connected to the electronic converter.

In various embodiments, the resistor 202 is replaced by an active pull-up device.

Figure 5:
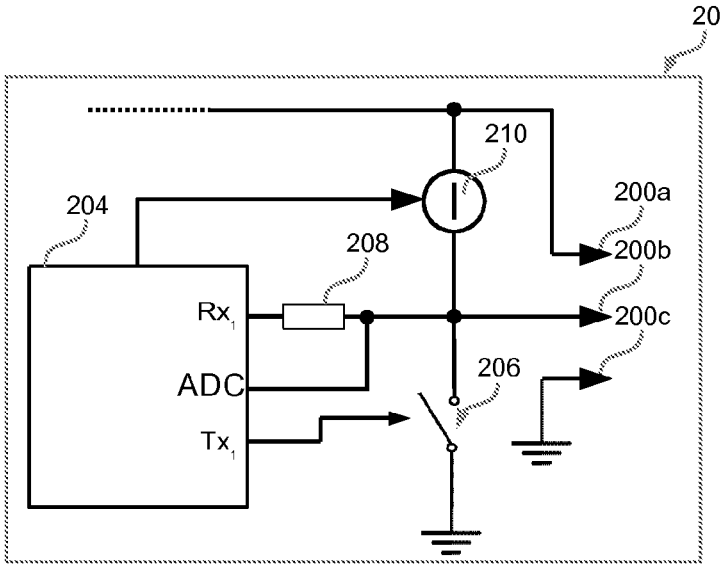
FIG. 5 is a circuit diagram of an embodiment of a control circuit.

For example, FIG. 5 shows a possible embodiment of a control circuit for an electronic converter comprising an active pull-up device, for example a current generator 210, connected between the power supply line 200*a* and the data line 200*b*. This generator 210 can also be controlled by means of the control unit 204.

In this case also, the active pull-up device 210 can be relocated in the identification element.

Figure 6:
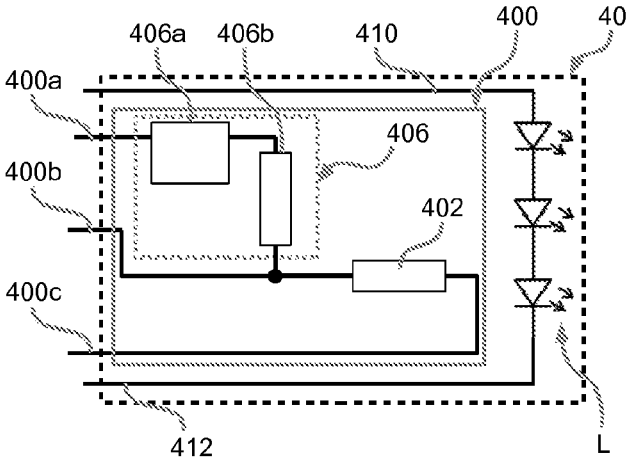
FIG. 6 is a circuit diagram of a third embodiment of a simple LED module.

For example, FIG. 6 shows an embodiment of a simple LED module 40 comprising an active pull-up device 406. For example, in the present embodiment, the active pull-up device 406 is formed by a voltage regulator 406*a* and a resistance 406*b*.

In this case also, an active pull-up device could be included in both the control circuit 20 and the identification element.

For example, the control unit could initially measure the voltage on the data line 200*b* by means of the input ADC and then decide whether the active pull-up device 208 is to be switched on or off.

Figure 7A:
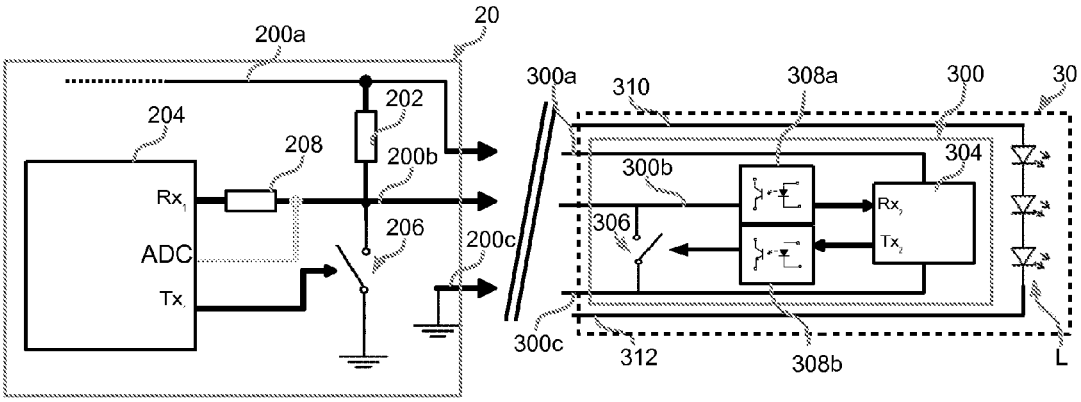
FIGS. 7*a* and 7*b* show, respectively, the connection of a control circuit to an intelligent LED module or to a simple LED module.
Figure 7B:
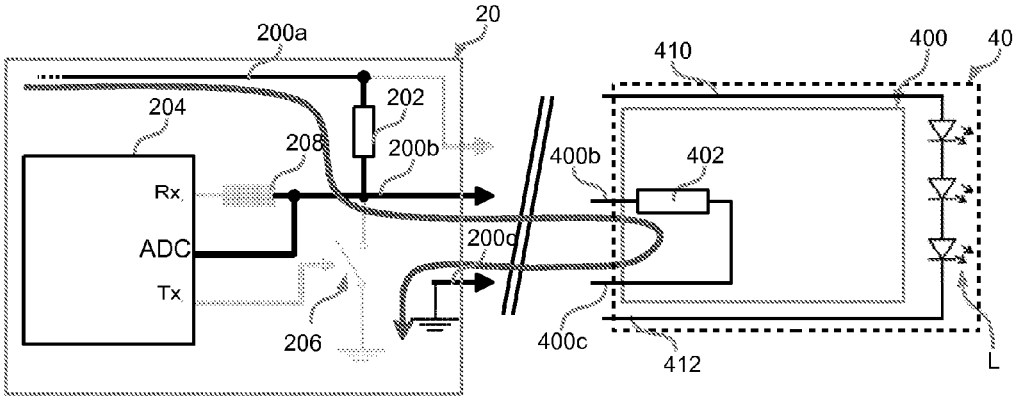

FIGS. 7*a* and 7*b* show possible embodiments of the connection of a control circuit 20 to an LED module.

In particular, FIG. 7*a* shows an embodiment in which a control circuit 20 is connected to an intelligent LED module 30.

In the present embodiment, the circuit 20 and the identification element 300 communicate during the normal operation of the system (that is to say, when the identification element has been classified) by means of the data line 200*a* and 300*a*, using a digital communication protocol. This means that the input ADC of the control unit 204 is not used during normal operation, and all the control parameters are exchanged in digital form.

FIG. 7*b* shows an embodiment in which a control circuit 20 is connected to a simple LED module 40.

In the present embodiment, the circuit 20 detects only the voltage on the data line 200*a* by means of the input ADC of the control unit 204, and the input RXi and the output Xi are not used.

In various embodiments, the control unit 20 measures the voltage on the data line 200*b* in order to distinguish a simple LED module 40 from an intelligent LED module 30.

In various embodiments, the control circuit measures the voltage on the data line 200*b* and compares the measured value with certain predetermined ranges in order to distinguish an intelligent LED module from a simple LED module, that is to say in order to classify the LED module connected to the electronic converter 10.

In various embodiments, the LED module connected to the electronic converter 10 is classified as simple if the voltage is within a first range, and it is classified as intelligent if the voltage is within a second range.

For example, in the case where a pull-up resistor is used in the control circuit only, the voltage on the data line 200*b* is determined by the voltage divider composed of the resistances 202 in the control circuit and the resistance between the data line and ground in the identification element (disregarding other resistances, for example those due to any connectors and/or connecting cables). The voltage on the data line 200*b* is therefore a linear function of the value of the resistance between the data line and the ground in the identification element.

In various embodiments, the resistance between the data line 400*b* and the ground 400*c* of a simple LED module 40 is substantially the resistance of the resistor 402. On the other hand, the resistance between the data line 300*b* and the ground 300*c* of an intelligent LED module 30 is substantially the resistance of the electronic switch (and of any optical isolator 306*a* that may be connected in parallel).

If a suitable range is used for the resistance of the resistor 402, an intelligent LED module can have a higher resistance if the electronic switch 306 is open, or a lower resistance if the electronic switch 306 is closed.

This makes it possible to specify certain ranges for the voltage on the data line which are associated with a simple or intelligent LED module.

The same is true in the case of an active pull-up device 210 in the control circuit 20. For example, if the active pull-up device is a current generator 210, the voltage on the data line 200*b* is directly proportional to the resistance between the data line and ground in the identification element (disregarding, once again, any other resistances, for example those due to any connectors and/or connecting cables).

On the other hand, if a pull-up resistor or an active pull-up device is used in the identification element, the corresponding values or parameters of the components can be set directly in such a way that the resulting voltages of a simple LED module and an intelligent LED module are in two separate ranges.

Figure 8:
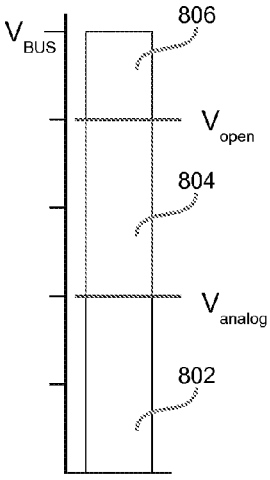
FIG. 8 shows a possible embodiment for the classification of the LED modules.

FIG. 8 shows a possible embodiment for the separation of these ranges.

In the present embodiment, a first range 802 between 0 V and anaiog, associated with a simple LED module, and a second range 804 between $V_{ana}i_{0g}$ and $V_{0pe}n$, associated with an intelligent LED module, are provided.

In the present embodiment, the electronic switch 306 is, for example, open, in such a way that the resistance between the data line and ground of an intelligent module is greater than that of a simple LED module.

In the present embodiment, a third range 806 is also provided, between $V_{0pe}n$ and $V_{bus}$, and is associated with an error state, in which $V_{bus}$ is the voltage on the power supply line 200*a*. $V_{bus}$ is therefore a reference voltage for the classification of the LED module.

This is because, if no LED module is connected (and if there is a pull-up device in the control circuit 20), the voltage on the data line 200*a* is substantially the voltage on the power supply line, namely $V_{bus}$. This enables the third range 805 to be associated with an error state which identifies, for example, the absence of an LED module, an incompatible LED module, and/or a defective LED module.

However, if the electronic switch 306 of an intelligent LED module is open, the resulting voltage is substantially the voltage $V_{bus}$.

In various embodiments, use is made of an intelligent LED module 30 comprising an element which defines a resistance between the data line 300*b* and the ground 300*c*, in order to enable a correct distinction to be made between an intelligent LED module and a disconnected LED module.

In various embodiments, this element can be a resistor connected in parallel with the electronic switch, or can be simply the resistance of the electronic switch 306 in the open condition, if the value of this resistance is sufficient.

In various embodiments, this element is a Zener diode connected in parallel with the electronic switch 306. This Zener diode can be used to set a maximum value of the voltage on the data line 300*c* to a predetermined value. For example, the Zener diode can also be integrated directly into the optical isolator 308*a* as an input protection diode.

Figure 9:
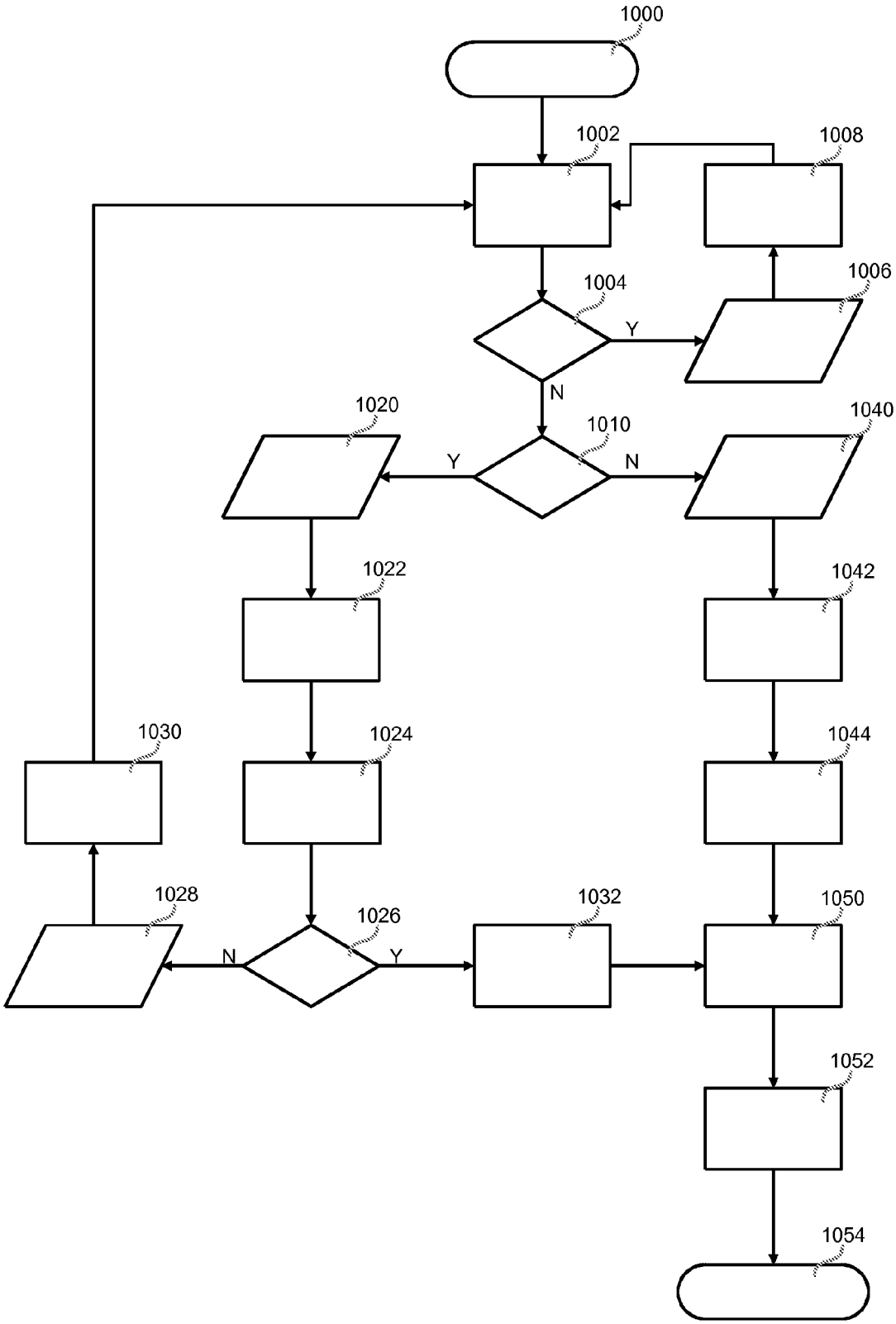
FIG. 9 is a flow diagram showing an embodiment of a control method capable of recognizing the type of an LED module.

FIG. 9 shows a possible embodiment of a control method which can be implemented in the control unit 204. For example, the steps of the method can also be implemented by means of pieces of software code which are executed by the control unit.

After an initial step 1000, the method continues with a step 1002 for detecting the voltage on the data line 200*b*.

A check is then made in a step 1004 to determine whether the measured voltage exceeds a voltage $V_0$pen—

If the result is positive (output "Y" of step 1004), the LED module is identified as disconnected or defective in a step 1006, and the method returns (possibly after a certain time interval) to step 1002. In this case, a step 1008 can also be provided for disabling the power output of the electronic converter which supplies the power for the LED or LEDs of the LED module.

In the contrary case (output "N" of the step 1004), the method continues to a step 1010 in order to verify the type of LED module connected to the electronic converter.

For example, in the present embodiment, this verification is implemented by determining if the measured voltage exceeds the voltage $V_{ana}i_{og}$.

If the result is positive (output "Y" of the step 1010), the LED module is identified in a step 1020 as an intelligent LED module. In the contrary case (output "N" of the step 1004), the LED module is identified in a step 1040 as a simple LED module. If the LED module has been identified as intelligent in the step 1020, the method continues to a step 1022 for sending an authentication request to the LED module along the data line 200*b*, and receives the response from the module in the step 1024.

A check is then made in a step 1026 to determine whether the authentication response is correct.

If the result is negative (output "N" of the step 1026), the LED module is identified as incompatible or defective in a step 1028, and the method returns to the step 1002. In this case also, a step 1030 can be provided for disabling the power output of the electronic converter which supplies the power for the LED or LEDs of the LED module.

In the contrary case (output "Y" of the step 1026), the LED module has been recognized correctly as an intelligent LED module, and the method uses the data line 200*b* to read the control parameter or parameters from the LED module in a step 1032.

The method then continues to a step 1050 in which the electronic converter is set as a function of the control parameters read from the LED module. For example, the step 1050 can include calculations for converting the control parameters supplied by the LED module into control parameters supported by the electronic converter. For example, if the control parameter identifies (or the control parameters identify) the current required by the LED module, the method sends instructions to the electronic converter in such a way that the required current is set. In this case, a step 1052 can also be provided to enable the power output of the electronic converter.

The method then terminates in a step 1054 or returns (possibly after a certain time interval) to the step 1002 to execute a new cycle of the method in such a way that changes in the control parameter are periodically monitored.

Persons skilled in the art will appreciate that the verification of any authentication data is entirely optional, and that the steps 1022 to 1030 can also be omitted. In this case, if the LED module has been identified as intelligent in the step 1020, the method could continue directly to the step 1032.

If the LED module has been identified as simple in the step 1040, the voltage measured in the step 1002 can be used directly in the step 1050 to set the electronic converter.

In the present embodiment, two further steps 1042 and 1044 are shown.

For example, in one embodiment, the electronic switch 206 is kept open during the step 1042, and the voltage on the data line 200*b* is measured again in the step 1044. Thus, a check can be made, for example before the electronic converter is set in the step 1050, to determine whether the measured voltage has remained substantially stable.

If the control circuit 20 and the simple LED module 40 each comprise a current generator, the step 1042 can also be used to disable the generator in the control circuit 20. Thus it can be guaranteed that the correct voltage will be measured on the data line 200*b*.

Various embodiments described here have numerous advantages, for example:

1) each electronic converter can operate with both types of LED module;

2) the user can replace an LED module with a more recent and/or effective version, without the need to replace the electronic converter (and vice versa);

3) the cables and/or connectors for connecting the LED modules to the electronic converter can be identical to each other, thus simplifying installation; and 4) the simple LED module does not require an additional control unit, and only one resistor is required to set the current required by the LED (or LEDs).

Naturally, the principle of the invention remaining the same, the details of construction and the forms of embodiment may be varied significantly with respect to those illustrated in the form of non-limiting examples only, without thereby departing from the scope of protection of the invention as defined in the attached claims.

The invention claimed is:

1. A method for controlling the operation of an electronic converter, comprising a power output for providing a power supply signal for a light source, wherein said light source is coupled to an identification element which identifies at least one control parameter of said light source, and a data line for connection to said identification element, wherein said method comprises:

detecting the value of the voltage on said data line;

comparing the detected value of said voltage with at least a first and a second range of values; and a) determining said at least one control parameter as a function of the detected voltage on said data line, if the detected voltage is within the first range, or b) communicating with said identification element by means of a digital communication protocol configured to receive said at least one control parameter from said identification element if the detected voltage is within the second range.

2. The method as claimed in claim 1, comprising the selective variation of said power supply signal for said light source as a function of said at least one control parameter.

3. The method as claimed in claim 1, wherein said first range is between 0 V and a first threshold.

4. The method as claimed in claim 3, wherein said second range is between said first threshold and a second threshold.

5. The method as claimed in claim 1, wherein said method comprises disabling said power output if said detected voltage is within a third range.

6. The method as claimed in claim 1, wherein said method comprises disabling said power output if said detected voltage is in a second range and if said identification element does not respond correctly to an authentication request.

7. The method as claimed in claim 1, wherein said identification element identifies at least the power supply current required by said light source.

8. An electronic converter comprising:

a power output for providing a power supply signal for a light source, in which said light source is coupled to an identification element which identifies at least one control parameter of said light source;

a data line for connection to said identification element; and a control circuit configured to execute the steps of the method as claimed in claim 1.

9. The electronic converter as claimed in claim 8, comprising a control unit, wherein said control unit comprises an analog-digital converter for measuring the voltage on said data line, and at least one terminal for detecting and driving the logic level of said data line.

10. The electronic converter as claimed in claim 9, comprising a pull-up resistor or an active pull-up device connected between said data line and a reference signal.

11. A lighting system comprising an electronic converter as claimed in claim 8 and a light source, wherein said light source is coupled to:

a first identification element comprising a resistive element, in which the resistance of said resistive element identifies at least one control parameter, or a second identification element comprising a control unit for transmitting at least one control parameter to said electronic converter along said data line, using a digital communication protocol.

12. The lighting system as claimed in claim 11, wherein said light source comprises at least one LED.

13. A software product which is loaded into the memory of a computer and which comprises pieces of software code for implementing the steps of the method as claimed in claim 1 when the product is executed on a computer.

* * * * *